US005497514A

United States Patent [19]

Miller

[11] Patent Number: 5,497,514

[45] Date of Patent: Mar. 12, 1996

[54] DRAIN CLEANING DEVICE

[76] Inventor: Floyd Miller, 9576 Harrodsburg Rd., Harrodsburg, Ind. 47434

[21] Appl. No.: 419,094

[22] Filed: Apr. 10, 1995

[51] Int. Cl.[6] ..... F03C 1/30

[52] U.S. Cl. ..... 4/255.04; 4/255.08; 138/109

[58] Field of Search ..... 4/255.01, 255.04, 4/255.05, 255.06, 255.07, 255.08, 255.09; 138/109

[56] References Cited

U.S. PATENT DOCUMENTS

| | | | |
|---|---|---|---|
| 2,283,780 | 12/1940 | Ahern . | |
| 2,315,673 | 2/1940 | Taylor . | |
| 3,217,093 | 11/1965 | Colorato | 138/109 |
| 3,605,135 | 9/1971 | Tan | 4/255.04 |
| 3,886,603 | 6/1975 | Onesta | 4/255.08 |
| 4,141,090 | 2/1979 | Rowan | 4/255.04 |
| 4,321,712 | 3/1982 | Dixon . | |
| 4,447,917 | 5/1984 | Walter | 4/255.09 |
| 5,092,367 | 3/1993 | Gilleland | 138/109 |

FOREIGN PATENT DOCUMENTS

| | | | |
|---|---|---|---|
| 403274 | 6/1966 | Switzerland | 4/255.01 |

*Primary Examiner*—Henry J. Recla
*Assistant Examiner*—Charles R. Eloshway
*Attorney, Agent, or Firm*—R. Steven Linne

[57] ABSTRACT

Disclosed is a low cost, easy to use cleaning apparatus to unclog or clean drain pipes or other conduits by directing high pressure water into contact with any solids in the pipe comprising a spray nozzle mounted in the end of a flexible water supply tube having, surrounding the nozzle, self centering fingers integrally formed by cutting slits or notches in the end of the supply tube and then inserting the nozzle which radially spreads the fingers.

6 Claims, 1 Drawing Sheet

DRAIN CLEANING DEVICE

FIELD OF THE INVENTION

This present invention relates generally to cleaning apparatus for directing liquid into contact with solids lodged in a drain pipe and more specifically to an apparatus having a flexible tube with an end mounted spray nozzle and guiding means for cleaning or unclogging pipes or conduits.

BACKGROUND OF THE INVENTION

Most homes, and even small businesses, do not have apparatus for efficiently unstopping or cleaning a blocked or slow running sink drain, especially when the blockage occurs in the pipes downstream from the sink. Generally the operator must rely on rubber plunger devices, which uses a brief pressure surge to try to dislodge a blockage, a small flexible wire or "snake" to mechanically cut through a blockage, or caustic and environmentally dangerous chemicals. Any such method may be so laborious, time consuming, or dangerous both to the operator and to the environment that often it is better to disassemble as much of the plumbing as is reachable and attempt to manually clean it out. However, all these methods are less effective, and often futile, if the blockage is distant from the drain opening at the sink. The pressure surge from a plunger dissipates over even a moderate distance and a snake has such a small diameter and short length compared to most drains that it will either not clean the sides of the pipe or reach the obstructed portion. A larger sized or longer snake often will not easily follow the turns of the pipes to reach the obstructed portion. Chemicals are most effective when used for blockages of organic material close to the drain opening, but are usually either ineffective or potentially more dangerous when used in sufficient quantities necessary to reach an obstruction far from the drain.

Various forms of specialty devices have been long known in the art for this purpose but all have some disadvantages. Many require special fittings and/or are expensive to manufacture. Few take advantage of the readily available water under pressure from a typical household faucet. For example, U.S. Pat. No. 2,283,780 to Ahern shows a low pressure dispenser of cleaning solutions having a long flexible tube with a brush on the end for cleaning a drain but it does not use a pressurized spray and cannot unclog a stopped drain. U.S. Pat. No. 2,315,673 to Taylor shows a side discharge nozzle on the end of a long flexible metal tube which apparently may be connected to a water faucet for cleaning drains but it does not appear useful for unclogging blocked pipes where the blockage is distant from the drain opening. More recently, U.S. Pat. No. 4,321,712 to Dixon teaches the use of a short, rigid connection for introducing cleaning or degreasing fluid under pressure near the beginning or the trap of a clogged drain. It does not spray the fluid deep inside the drain near the site of the stoppage, unless the blockage happens to be in or near the trap. None of the foregoing have any means for centering or guiding the cleaning tube in a pipe.

It is therefore an object of the present invention to provide a new and improved device, and methods of making and using same, for cleaning and/or unclogging drain pipes which is easy to use and inexpensive to manufacture. It is a further object to provide a drain cleaning device which utilizes readily available household water pressure to effectuate the removal of the blockage or obstruction in the drain conduit.

SUMMARY OF THE INVENTION

The present invention aims to overcome some of the disadvantages of the prior art as well as offer certain other advantages by providing an improved, self-centering, guiding and spraying assembly, which is on the distal end of a relatively long, flexible plastic tube connected to the household water supply, for cleaning solid debris from or unclogging blockages and obstructions downstream of a drain opening in a drain conduit. The apparatus comprises a hollow flexible tube of a length sufficient to reach the solids in the conduit when inserted into the conduit. Means for connoting a supply of water under pressure is connected to one proximal end of the tube so that water under pressure can be passed through the hollow tube. A spraying means is mounted on the other distal end of the tube. The spraying means is adapted to direct water passed through the tube against the solids when the tube and spraying means are inserted into the drain conduit until the spraying means is in direct proximity to the solids in the drain conduit. Guiding means is mounted to the distal end of the tube for centering and guiding the tube and spray means through the drain conduit and facilitating the passage of the tube and spray means around any bends and turns in the drain conduit.

The guide means may comprise a multiplicity of radially outwardly extending fingers mounted on the distal end of said tube, and those finger may be formed by cutting longitudinal slits in the distal end of the flexible tube and inserting the spraying means into the hollow opening at the distal end of the tube to cause the portions of the tube between said longitudinal slits to radially spread outwardly.

The spray means may comprise a multiplicity of water ejector openings that communicate with the hollow interior of the tube so that the water under pressure passed through the tube is directed both longitudinally and transversely from the spray means.

The tube may be formed in sections that can be connected to one another to vary the length of the tube so that the tube will reach the obstruction in the drain conduit.

The invention also comprises a method of removing solids obstructing a drain conduit comprising the steps of inserting a hollow flexible fluid supply tube connectable to a source of pressurized water at one proximal end and having a guide means and spray means mounted to the other distal end of said tube, maneuvering the tube in the conduit until the spray means is in the immediate proximity of the solids obstructing the drain conduit, and passing pressurized water through said tube and said spray means against the solids obstructing the drain conduit until the solids are loosened and the obstruction removed.

BRIEF DESCRIPTION OF THE DRAWINGS

While this specification concludes with claims particularly pointing out and the subject matter which is now regarded as the invention, it is believed that the broader aspects of the invention as well as several of the features and advantages thereof may be better understood from the following detailed description of a presently preferred embodiment when taken in connection with the accompanying drawings in which:

DETAILED DESCRIPTION OF THE INVENTION

Figure 1:
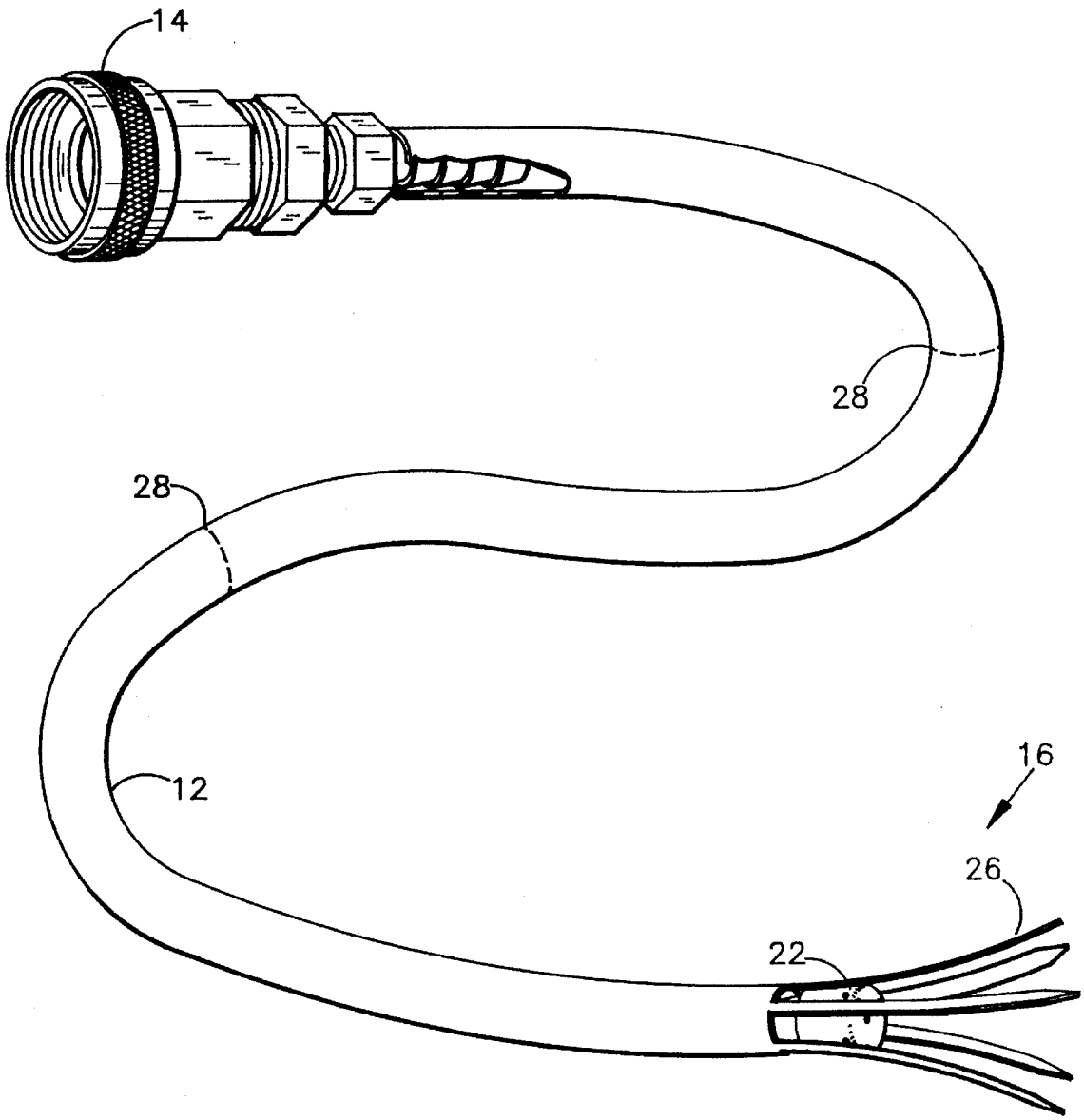
FIG. 1 is a simplified illustration of the drain cleaning device of the present invention.
Figure 2:
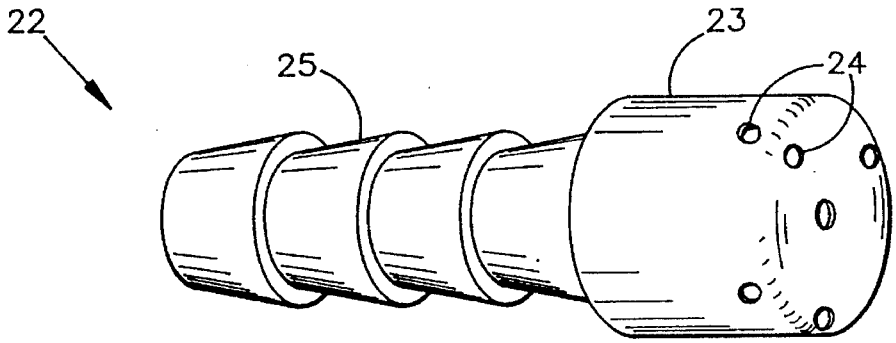
FIG. 2 is an enlarged view of the spraying nozzle inserted in one end of the cleaning device of FIG. 1.

As shown in FIG. 1, the present cleaning device generally comprises a relatively long flexible tube (12) having a means for connection (14) to a water supply (not shown) on one end and a spraying and guiding assembly (16) on the other end. Preferably, the water tube (12) is made of a flexible plastic, such as polypropylene or the like, which tends to hold its shape but without being so rigid as to not easily bend around turns in a drain pipe. The proper flexibility of the tube (12) is important for ease of use. The water connection means (14) may be of any of the common types well known in the art such as a rigid, threaded pipe fitting that threats onto a threaded faucet or an elastic, rubber slip-on fitting that can be inserted over the end of a faucet regardless of its shape. The spraying and guiding assembly (16) includes a spray nozzle (22), having multiple water ejector holes (24) as shown more clearly in FIG. 2, surrounded by several flexible finger means (26) for centering the assembly in a pipe or conduit. In this embodiment, the finger means (26) are integrally formed at the distal end of the tube (12) by cutting slits or notches in the end of the tube (12) before insertion of the nozzle (22) into the open end of tube (12) which radially spreads the fingers outwardly as shown in FIG. 1. Of course, the outside diameter of the head portion (23) of nozzle (22) must be somewhat larger than the inside diameter of the hollow opening in tube (12) to achieve proper spreading of the fingers (26). Nozzle (22) also comprises a mating portion (25) of a diameter smaller than head portion (23), but sized to fit into but be securely retained in the hollow opening of tube (12) even under water pressure. The guide fingers could also be separately formed and mounted to either the exterior surface of the nozzle (22) or the tube (12).

In use, the connection means (14) on one proximal end of the tube (12) is connected to a source of pressurized water, typically household faucet (not shown). The spraying and guiding assembly (16) on the other distal end of tube (12) is inserted into the drain opening where the fingers (26) tend to center the nozzle (22) in the drain conduit and may also help to scrape sticky solids from the walls. The nozzle (22) is maneuvered down the drain conduit by pushing the tube (12) slowly into the conduit until the nozzle (22) contacts the solid obstruction in the drain. The water faucet is then turned on and water flows through the tube (12) and nozzle (22) and sprays forwardly and transversely from the multiple ejector holes (24) in the nozzle (22) to loosen and remove any nearby solid deposits. The tube (12) and nozzle (22) can be repeatedly and continuously moved down the conduit until the obstructed drain conduit is opened.

Typically, if the drain is completely blocked, the water is turned on only momentarily to loosen the surface portion of the obstruction and then the nozzle (22) is pushed further down the drain and the process repeated again. In this way, the obstruction can be removed without causing so much water to be used that the sink will overflow before the blockage is removed and drainage restored.

Tube (12) can advantageously be formed in multiple sections and joined together at junctions (shown by dotted lines 28 in FIG. 1) by any of a number of conventional tube connectors (not shown) such as press on fittings or threaded fittings. In this manner the length of the tube (12) can be varied to reach obstructions of varying distants from the drain opening.

While the present invention has been described in terms more or less specific to one preferred embodiment, it is expected that various alterations, modifications, or permutations thereof will be readily apparent to those skilled in the art. Therefore, it should be understood that the invention is not to be limited to the specific features shown or described, but it is intended that all equivalents be embraced within the spirit and scope of the invention as defined by the appended claims.

What is claimed is:

1. Apparatus for cleaning solids obstructing an interior of a drain conduit comprising:

a hollow flexible tube having a proximal end and a distal end and of a length sufficient to reach the solids in the conduit when the distal end is inserted into the conduit;

means for connecting a controllable supply of water under pressure to said proximal end of said tube so that water under pressure can be passed through said tube;

a spraying means mounted at said distal end of said tube, said spraying means for directing water passed through said tube against the solids in the drain conduit when the tube and spraying means are inserted into the drain conduit until said spraying means is in direct proximity to the solids in the drain conduit; and guiding means mounted at the distal end of said tube for centering and guiding said tube and spraying means through said drain conduit and facilitating the passage of said tube and spraying means around any bends and turns in the drain conduit;

said guiding means comprising a multiplicity of radially outwardly extending fingers mounted at the distal end of said tube; and, wherein said fingers are formed by cutting longitudinal slits in the distal end of said flexible tube and inserting said spray means into the distal end of said tube to cause portions of said tube between said longitudinal slits to spread radially outwardly.

2. The apparatus of claim 1 wherein the spray means comprises multiple water ejector openings that communicate with said tube so that said water under pressure passed through said tube is directed both longitudinally and transversely from said spray means.

3. The apparatus of claim 1 wherein said tube is formed in multiple sections of predetermined length that can be connected to one another in varying numbers to vary the total length of said tube.

4. A method of removing solids obstructing a drain conduit comprising the steps of:

connecting a proximal end of a hollow flexible fluid spray tube to a controllable source of water under pressure;

inserting a distal end of said hollow flexible fluid spray tube having a guide means and spray means mounted to said distal end of said tube into the drain conduit;

said guide means being formed by cutting longitudinal slits in said hollow flexible fluid spray tube and causing portions of the tube between said slits to radially spread outwardly by insertion of said spray means into said distal end;

maneuvering said tube in said conduit until said spray means is in the immediate proximity of the solids obstructing the drain conduit;

passing pressurized water through said tube and said spray means against the solids obstructing the drain conduit until the solids are loosened and the obstruction is removed.

5. The method of claim 4 wherein said spray means comprises multiple water ejector openings that communicate with said tube and so that said water under pressure passed through said tube is directed both longitudinally and transversely from said spray means.

6. The method of claim 4 wherein the method also comprises the step of varying the length of said tube by connecting multiple sections of said tube together so that said tube will reach the solids obstructing the drain.

* * * * *